US006216777B1

(12) United States Patent
Rhodes et al.

(10) Patent No.: US 6,216,777 B1
(45) Date of Patent: Apr. 17, 2001

(54) MANIFOLD FOR A HEAT EXCHANGER AND METHOD OF MAKING SAME

(75) Inventors: Eugene E Rhodes, Belleville; Ramchandra L Patel, Southgate, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/492,414

(22) Filed: Jan. 27, 2000

(51) Int. Cl.[7] ..... F28F 9/02
(52) U.S. Cl. ..... 165/176; 165/175; 29/890.052
(58) Field of Search ..... 165/140, 173, 165/175, 176; 29/890.052

(56) References Cited

U.S. PATENT DOCUMENTS 3,368,617 * 2/1968 Rosman et al. ..... 165/175
4,770,240 * 9/1988 Dawson et al. ..... 165/176
5,163,509 11/1992 Dawson ..... 165/176
5,190,101 3/1993 Jalilevand et al. ..... 165/176

FOREIGN PATENT DOCUMENTS 59-104096 * 6/1984 (JP) ..... 165/176
5/1896 * 1/1993 (JP) ..... 165/176

* cited by examiner

*Primary Examiner*—Allen Flanigan
(74) *Attorney, Agent, or Firm*—Larry I. Shelton

(57) ABSTRACT

A manifold for a heat exchanger includes a base member having a plurality of tubular members for connection to tubes of a heat exchanger. The manifold also includes a plurality of folds disposed between the tubular members to form a channel above a plane of the base member. The manifold includes a first side member extending from a side edge of the base member and a second side member extending from another side of the base member and opposing the first side member. The free ends of the first side member and the second side member are disposed in the channel and secured in place between the folds to define a first fluid conduit and a second fluid conduit.

20 Claims, 2 Drawing Sheets

MANIFOLD FOR A HEAT EXCHANGER AND METHOD OF MAKING SAME

BACKGROUND OF THE INVENTION

1. Field of the Invention

The present invention relates generally to heat exchangers for motor vehicles and, more specifically, to a manifold and method of making same for a heat exchanger in a motor vehicle.

2. Description of the Related Art

It is known to provide a heat exchanger such as a condenser for an air conditioning system of a motor vehicle. The heat exchanger typically includes a plurality of U-shaped tubes having a fluid passing therethrough and a plurality of fins extending between the tubes. The number of U-shaped tubes depends on thermal capacity requirements of the heat exchanger. In order to connect these tubes together so that the fluid can flow through the tubes, manifolds are used having a series of openings corresponding to and mating with the ends of the tubes. The manifolds have an inlet port and an outlet port which circulate the fluid through the heat exchanger and then return the fluid to a remote location for subsequent recycling.

It is also known to fabricate manifolds as an extrusion using an extruding process. An example of such a method to make a manifold is disclosed in U.S. Pat. No. 5,190,101. In this patent, a manifold for a heat exchanger is fabricated by extruding a generally planar base member with a U-shaped channel disposed below a plane thereof and a pair of vertically depending walls projecting generally perpendicularly to the plane of the base member. The method includes forming a plurality of fluid conducting passageways in the base member and rolling the vertical depending walls toward a longitudinal center of the base member until the free ends of the walls are disposed in the channel of the base member to form fluid conduits. However, these extruded manifolds are relatively expensive to produce.

It is further known to fabricate manifolds as a stamping using a stamping process. An example of such a method to make a manifold is disclosed in U.S. Pat. No. 5,163,509. In this patent, a manifold assembly for a heat exchanger includes a first manifold and a second manifold. The first manifold has a first hollow conduit and a first plurality of apertures through the first conduit. The second manifold has a second hollow conduit and a second plurality of apertures through the second conduit. The manifold assembly includes at least one joining member between the first and second manifolds for joining the first manifold to the second manifold with the first conduit being side-by-side and adjacent the second conduit. The joining member includes a region of weakness for facilitating separation of the first and second manifolds. The manifold assembly is fabricated by stamping and bending a single elongate sheet metal strip.

Although the above manifolds have worked, they suffer from the disadvantage that the extruded manifolds are relatively costly to manufacture. Another disadvantage of the above manifolds is that the stamped manifolds have a portion extending above the plane of the fluid conduits. Yet another disadvantage of the above manifolds is that the stamped manifolds have a pair of seams that are brazed which may result in leakage of fluid if not brazed properly. Still another disadvantage of the above manifolds is that extruded manifolds have a U-shaped channel disposed below a plane of the base member, which is undesired. Therefore, there is a need in the art to provide a manifold for a heat exchanger of a motor vehicle that overcomes these disadvantages.

SUMMARY OF THE INVENTION

Accordingly, the present invention is a manifold for a heat exchanger including a base member having a plurality of tubular members for connection to tubes of a heat exchanger. The manifold also includes a plurality of folds disposed between the tubular members to form a channel above a plane of the base member. The manifold includes a first side member extending from a side edge of the base member and a second side member extending from another side of the base member and opposing the first side member. The free ends of the first side member and the second side member are disposed in the channel and secured in place between the folds to define a first fluid conduit and a second fluid conduit.

Also, the present invention is a method of making a manifold for a heat exchanger. The method includes the steps of providing a generally planar sheet having a base member with a plurality of tubular members for connection to tubes of a heat exchanger. The method also includes the step of folding the sheet and forming a plurality of folds between the tubular members to form a channel above a plane of the base member. The method includes the step of folding lateral side edges of the sheet to form a first side member and a second side member opposing each other. The method further includes the step of folding free ends of the first side member and the second side member toward each other and disposing the free ends in the channel to define a first fluid conduit and a second fluid conduit.

One advantage of the present invention is that a stamped manifold for a heat exchanger such as a condenser is provided for an air conditioning system of a motor vehicle for condensing liquid refrigerant. Another advantage of the present invention is that the manifold uses a sheet that is stamped, folded and brazed to make a manifold. Yet another advantage of the present invention is that the manifold is stamped and folded and is less costly and more economical to manufacture than an extruded manifold.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
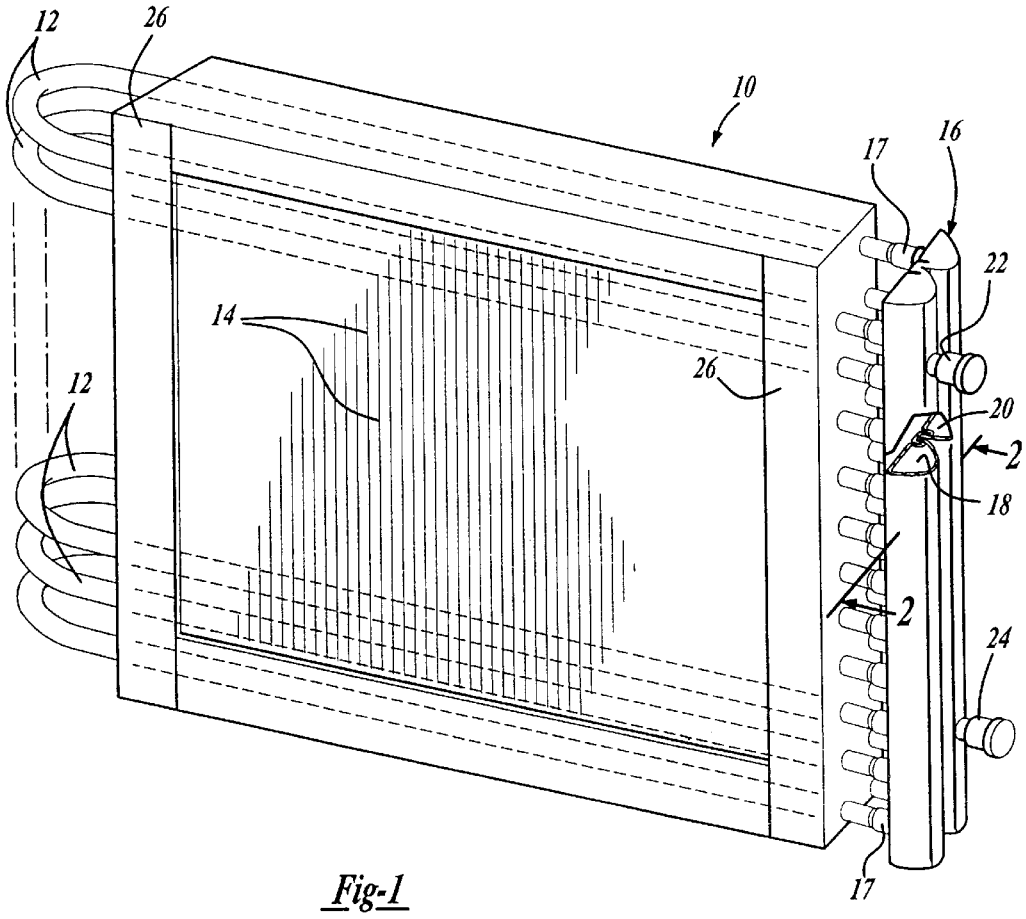
FIG. 1 is a perspective view of a manifold, according to the present invention, illustrated in operational relationship with a heat exchanger.

Referring to the drawings and in particular FIG. 1, one embodiment of a heat exchanger 10, such as a condenser for an air conditioning system (not shown), is shown for a motor vehicle (not shown). The heat exchanger 10 is of a tube and fin type and includes a plurality of U-shaped tubes 12 with a plurality of heat dissipative fins 14 extending between each of the tubes 12. The heat exchanger 10 also includes a manifold, generally indicated at 16 and according to the present invention, matingly engaging generally cup-shaped free ends 17 of the tubes 12 and disposed at one end of the heat exchanger 10. As illustrated, the manifold 16 is a double chambered manifold having a first fluid conduit 18 and a second fluid conduit 20. The first fluid conduit 18 includes an inlet port 22 for receiving fluid therein and the second fluid conduit 20 includes an outlet port 24 for discharge of fluid therefrom. Fluid to be cooled (or heated) enters the manifold 16 through the inlet port 22 and is directed through the tubes 12 wherein the fluid is cooled by a secondary fluid, such as air, passing over the fins 14. Baffles (not shown) in the manifold 16 direct the fluid through the tubes 12 wherein the fluid eventually discharges from outlet port 24. The heat exchanger 10 may include end plates 26 to support the tubes 12 for the manifold 16. It should be appreciated that, except for the manifold 16, the heat exchanger 10 is conventional and known in the art. It should also be appreciated that the manifold 16 could be used for heat exchangers in other applications besides motor vehicles.

Figure 2:
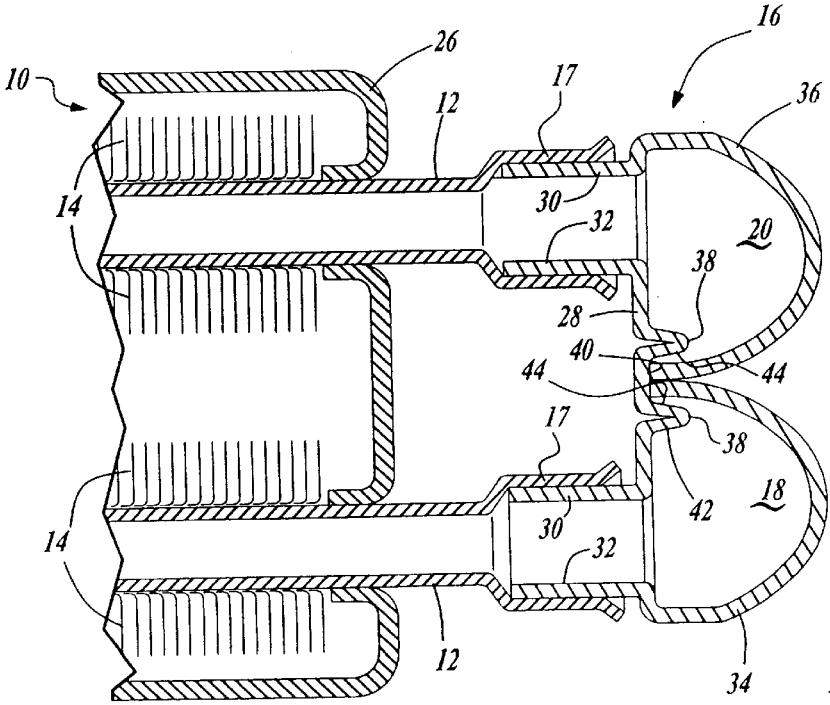
FIG. 2 is a sectional view taken along line 2—2 of FIG. 1.

Referring to FIGS. 1 and 2, the manifold 16 extends longitudinally. The manifold 16 includes a base member 28 being generally planar and extending laterally. The manifold 16 also includes a plurality of tubular members 30 extending generally perpendicular to the base member 28. The tubular members 30 have a generally circular cross-sectional shape with a fluid passageway 32 extending therethrough and fluidly communicating with the first fluid conduit 18 and the second fluid conduit 20. The tubular members 30 and base member 28 are integral, unitary and formed as one-piece from a metal material such as aluminum. It should be appreciated that the tubular members 30 are secured to the tubes 12 by suitable means such as brazing.

The manifold 16 also includes a first side member 34 along one side of the base member 28. The first side member 34 is generally arcuate in cross-sectional shape. The manifold 16 includes a second side member 36 along the other side of the base member 28 and opposing the first side member 34. The second side member 36 is generally arcuate in cross-sectional shape. The first and second side members 34 and 36 and the base member 28 are integral, unitary and formed as one piece from a metal material such as aluminum. It should be appreciated that the first side member 34 and second side member 36 may have any suitable cross-sectional shape.

The manifold 16 includes at least one, preferably a plurality of folds 38 extending from the base member 28 between a pair of laterally spaced tubular members 30 to form a channel 40. In the embodiment illustrated, two folds 38 are spaced laterally and extend generally perpendicular to and above a plane of the base member 28. Each of the folds 38 extends longitudinally and has a first portion 42 and a second portion 44. Each fold 38 is formed by folding the base member 28 to form the first portion 42 and back on itself to form the second portion 44 to obtain a predetermined fold height. In the embodiment illustrated, the predetermined fold height is approximately 5.5 mm. The folds 38 and base member 28 are integral, unitary and formed as one-piece from a metal material such as aluminum. It should be appreciated that the channel 40 is disposed above the plane of the base member 28.

After the folds 38 are formed, the free ends of the first side member 34 and second side member 36 are disposed in the channel 40 to form the first fluid conduit 18 and second fluid conduit 20, respectively. The manifold 16 has its inner and outer surfaces coated with a known brazing material. As a result, the brazing material flows between the base member 28, folds 38, first side member 34 and second side member 36 by capillary flow action to braze the first side member 34 and second side member 36 and base member 28 together in the channel 40.

Figure 3A:
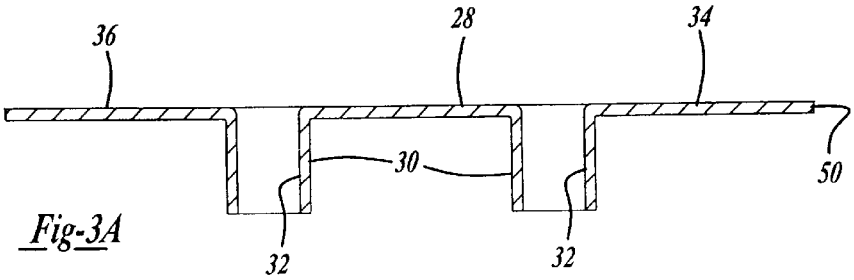
FIGS. 3A through 3D illustrate steps of a method, according to the present invention, of making the manifold of FIG. 1.
Figure 3B:
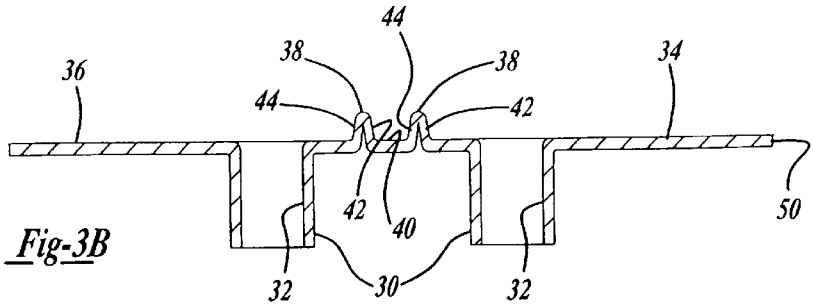
Figure 3C:
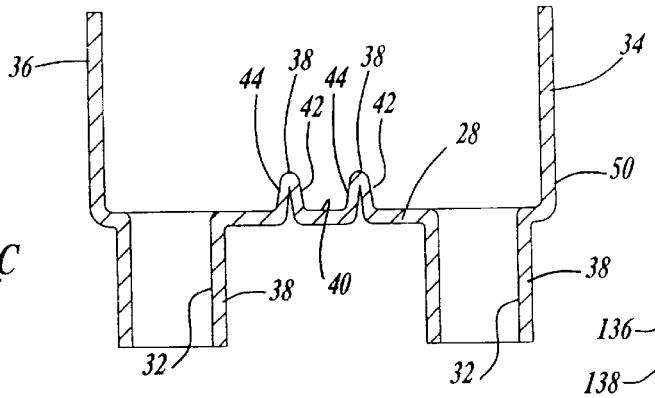
Figure 3D:
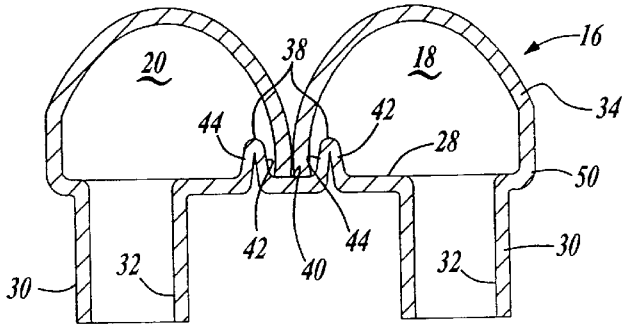

Referring to FIGS. 3A through 3D, a method, according to the present invention, of the making the manifold 16 is shown. The method includes the step of providing a generally planar sheet 50 of elongate, deformable material such as aluminum coated with a braze material. The method includes the step of forming the sheet 50 into a base member 28 with tubular members 30 and having the first side member 34 and second side member 36 along a longitudinal length thereof as illustrated in FIG. 3A. The sheet 50 is provided as a stamping. The method includes the step of folding the sheet 50 between the tubular members 30 to form the folds 38 with the first portion 42 and the second portion 44 to a predetermined fold height above a plane of the base member 28 as illustrated in FIG. 3B. The method includes the step of flanging the lateral outer edges of the sheet 50 to form the first side member 34 and second side member 36 as illustrated in FIG. 3C. The method also includes the step of folding or rolling the first side member 34 and second side member 36 toward one another until their free ends are disposed in and meet in the channel 40 to form the first fluid conduit 18 and second fluid conduit 20 as illustrated in FIG. 3D. The free ends of the first side member 34 and second side member 36 are locked or secured in place between the folds 38. The method includes the step of forming ends of the fluid conduits 18 and 20 and assembling adapters into drilled holes in the first and second side members 32 and 34 to form the inlet 22 and outlet 24. The method includes the step of brazing the manifold 16 by heating the manifold 16 to a predetermined temperature to melt the brazing material to braze the base member 28, folds 38, first side member 34 and second side member 36 together and cooling the manifold 16 to solidify the molten braze material to secure the base member 28, folds 38, first side member 34 and second side member 36 together.

Figure 4:
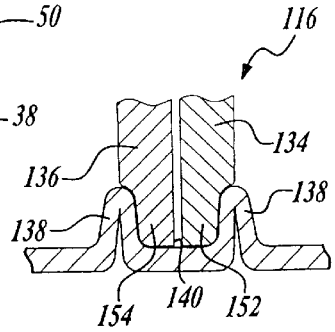
FIG. 4 is a partial fragmentary view of another embodiment, according to the present invention, of the manifold of FIGS. 1 and 2.

Referring to FIG. 4, another embodiment 116, according to the present invention, of the manifold 16 is shown. Like parts of the manifold 16 have like reference numerals increased by one hundred (100). In this embodiment, the free ends of the first side member 134 and second side member 136 have side margins or edges 152 and 154, respectively, of a thickness less than a thickness of a remainder thereof. The side edges 152 and 154 are disposed in the channel 140. The side edges 152 and 154 allow the channel 140 to have a width less than the width of the remainder or original thickness of both side members 134 and 136. The side edges 152 and 154 may be formed by laterally compressing the folds 138 after the side members 134 and 136 are disposed therebetween.

Accordingly, the manifold 16 is a cost reduction over current manifolds that are made from a dual extruded tube with tubular members back extruded. The manifold 16 has a sheet with extruded tubular members or risers and is folded and brazed to make the manifold.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A manifold for a heat exchanger comprising:

a base member having a plurality of tubular members for connection to tubes of a heat exchanger;

a plurality of folds disposed between said tubular members to form a channel above a plane of said base member;

a first side member extending from a side edge of said base member;

a second side member extending from another side of said base member and opposing said first side member; and free ends of said first side member and said second side member being disposed in said channel and secured in place between said folds to define a first fluid conduit and a second fluid conduit.

2. A manifold as set forth in claim 1 wherein said base member, said folds, said first side member and said second side member are integral, unitary and formed as one-piece.

3. A manifold as set forth in claim 1 wherein said folds comprise a first fold and a second fold spaced laterally and extending longitudinally and generally perpendicular to said base member.

4. A manifold as set forth in claim 1 wherein each of said folds has a first portion and a second portion adjacent said first portion and being formed from said base member.

5. A manifold as set forth in claim 1 wherein said first side member and said second side member have a generally arcuate shape.

6. A manifold as set forth in claim 1 wherein said manifold is a stamping.

7. A manifold as set forth in claim 1 wherein said manifold is made from an aluminum sheet.

8. A manifold as set forth in claim 1 wherein said free ends each have a side edge of a thickness less than a thickness of said first side member and said second side member, each side edge being disposed in said channel.

9. A manifold as set forth in claim 8 wherein said channel has a width less than a thickness of both said first side member and said second side member.

10. A method of making a manifold for a heat exchanger comprising the steps of:

providing a generally planar sheet having a base member with a plurality of tubular members for connection to tubes of a heat exchanger;

folding the sheet and forming a plurality of folds between the tubular members to form a channel above a plane of the base member;

folding lateral side edges of the sheet to form a first side member and a second side member opposing each other; and folding free ends of the first side member and the second side member toward each other and disposing the free ends in the channel to define a first fluid conduit and a second fluid conduit.

11. A method as set forth in claim 10 including the step of securing the free ends in the channel.

12. A method as set forth in claim 11 wherein said step of securing comprises brazing.

13. A method as set forth in claim 10 wherein said step of forming the folds comprises folding the sheet and forming a first portion and folding the sheet back on itself to form a second portion.

14. A method as set forth in claim 10 wherein said step of folding lateral side edges comprises flanging the lateral side edges of the sheet to form a first side member and a second side member opposing each other.

15. A method as set forth in claim 10 wherein said step of folding free ends comprises rolling the free ends of the first side member and the second side member toward each other and disposing the free ends in the channel to define a first fluid conduit and a second fluid conduit.

16. A method as set forth in claim 10 wherein said step of providing comprises providing a stamped planar sheet having a base member with a plurality of tubular members for connection to tubes of a heat exchanger.

17. A method as set forth in claim 10 including the step of forming the free ends of the first side member and second side member with a side edge of a thickness less than a thickness of the first side member and the second side member.

18. A method as set forth in claim 17 including the step of disposing each side edge of the free ends in the channel.

19. A method as set forth in claim 17 including the step of forming the channel with a width less than a thickness of both the first side member and the second side member.

20. A method as set forth in claim 10 including the step of compressing the folds and free ends of the first side member and second side member.

* * * * *